United States Patent [19]

Nakagawa et al.

[11] 3,978,706

[45] Sept. 7, 1976

[54] PRECISION BENDING WORK METHOD FOR METALLIC MATERIALS

[75] Inventors: Takeo Nakagawa; Teiichi Ohtsuki, both of Tokyo, Japan

[73] Assignee: Nippon Kokan Kabushiki Kaisha, Tokyo, Japan

[22] Filed: Dec. 24, 1974

[21] Appl. No.: 536,160

[52] U.S. Cl. ..... 72/389; 72/396; 72/465

[51] Int. Cl.[2] ..... B21D 7/06

[58] Field of Search ..... 72/396, 465, 381, 389, 72/379, 382, 385, 386

[56] References Cited

UNITED STATES PATENTS

| | | | |
|---|---|---|---|
| 2,433,841 | 1/1948 | Glud | 72/396 |
| 2,893,459 | 7/1959 | Kosek | 72/396 |
| 2,935,111 | 5/1960 | Krause | 72/382 |
| 3,209,576 | 10/1965 | Giordano | 72/389 |
| 3,276,239 | 10/1966 | Achler | 72/465 |
| 3,844,156 | 10/1974 | Hanni | 72/389 |

*Primary Examiner*—C.W. Lanham
*Assistant Examiner*—Gene P. Crosby
*Attorney, Agent, or Firm*—Moonray Kojima

[57] ABSTRACT

When bend working a metallic material using a suitable counterpressure against the material concurrently with the application of the bending force, and using a pair of dies having the distance therebetween controlled to be 3.5 to 6 times the thickness of the material, very precise bending deformation region can be easily and stably obtained without any defects, such as camber, looseness, fin, cracks or breaks.

2 Claims, 14 Drawing Figures

PRECISION BENDING WORK METHOD FOR METALLIC MATERIALS

The present invention relates to an improved bend working method and a bending device for a metallic material, and more particularly the invention aims to obtain a very precise bent deforming region showing no camber, looseness, fin, crack or break.

In bend working a metallic material, it is well known in the art that such grave problems occur, such as generation of crack camber, fin such as edge face of bended region not becoming perpendicular to the surface or spring-backs or the like. To prevent the foregoing defects during bend working on said material, a prior method uses a larger bending radius than the minimum bending radius which is the critical value of the material being used. For example, a bending curvature of 175mm (outside) is used for thickness of 25mm, 118mm for thickness of 32mm, 160mm for thickness of 40mm, so forth. Such a method did help to prevent crack generation, but did not achieve production of goods with the desired shape after bending. They caused inconveniences when used as structural materials in attaching the parts, etc, and they presented disadvantages in respect of a finished design. In addition, the above method merely acheived prevention of crack generation and did not solve such problems as spring back camber, or fin as edge of bended region being not perpendicular to the surface. These remained as grave problems in the processing art for soft steels being the greater part of the metallic materials subjected to bending work. An improvement of such technical difficulties in bend work has been in demand quite strongly among the fields concerned.

The present invention has successfully developed a method and a device to remove the above mentioned problems. The features of this invention fundamentally lie in that a region to be bend worked, is subjected to local compression in the thickness direction of a metallic material by means of placing a counter rod exerting a suitable counter pressure on the material against the pressure exerted by a punch.

An object of this invention is to provide an improved bend-working method and device for a metallic material, wherein it is possible to bend work without any generation of camber, looseness, fin, crack or break, or the like.

Another object of this invention is to provide a structural member being easily and stably worked into a desired structure without any problems.

Other objects and advantages will be apparent from the following description and with the accompanying drawings in which.

Figure 1:
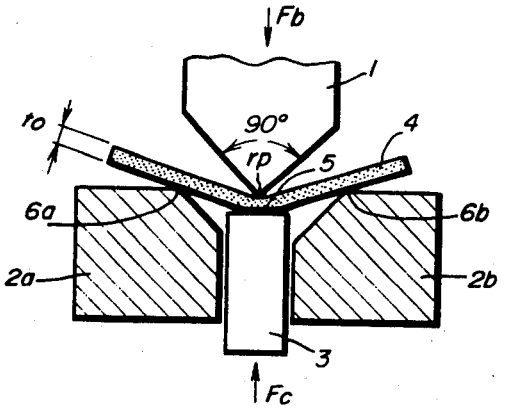
FIG. 1 is an explanatory view concerning a principle of this invention.

Referring now to FIG. 1, there is shown a principle and fundamental device of bend-working based on this invention. In FIG. 1, numeral 1 shows a punch; 2*a* and 2*b* are two die blocks having a space therebetween; 3 is a counter rod or plate placed between the dice 2*a*, 2*b*; and 4 is a metallic material. A suitable pushing-down pressure F*b* is put on the punch 1 by a known means (not shown) and a suitable counter-pressure F*c* against it is effected on the counter rod or plate 3 by a known means, e.g. hydraulic mechanism (not shown). In the above case, when the punch 1 is punched down as putting the counter pressure on the rod or plate 3, the material 4 is subjected to bend-work through shoulders 6*a* and 6*b* of the dice 2*a* and 2*b*. Briefly speaking, a suitable compressive force is aggressively given to the required bend-working region of material during processing. Such a compressive force is easily obtained by the above-mentioned counter pressure F*c*. This is a fundamental features of this invention. According to many experiments, a process adding said compressive force after finishing of the bending-work did not prevent the generating of cracks.

Figure 2:
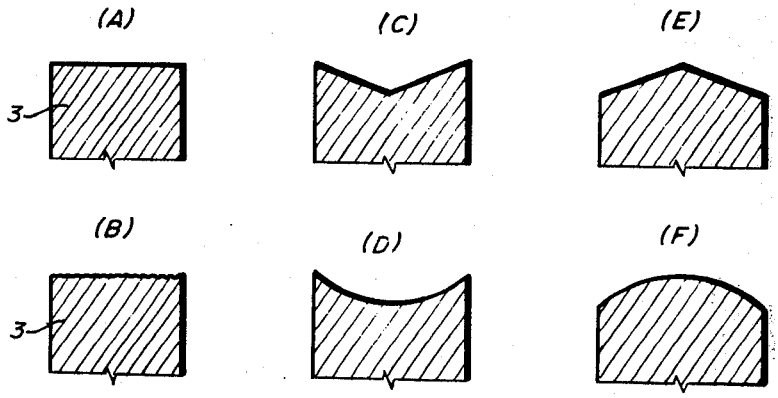
FIG. 2 shows various surface shapes of a counter rod based on this inventions.

FIG. 2 shows various shapes of the upper face of a counter-rod or plate based on this invention. The above upper face of FIG. 2(A) is flat. In FIG. 2(B), a rough face is formed FIG. 2(C) has a gentler inclination face of V shape than that of shoulder angle of the punch. FIG. 2(D) is an example in which the face as shown in the above (C) is curved, i.e. a concave. FIGS. 2(E) and (F) are an example in which the face as shown in the above (C) or (D) is formed in the opposite manner thereto, respectively, i.e. a conical shape or a convex shape. Thus, an actual shape of the upper face (including various modified shapes) is adopted as the occasion calls for in bend-working.

It is well-known that various defects such as bending-crack, spring-back, camber, fin or the like tend to be generated in general bend-working. That is, these defects are based on the following reasons. First, the bending-crack or the spring-back is based on a physical behavior that inside surface stress generating under bend-working acts as a compressive force for the metallic material, at the same time, outside surface stress acts as a tensile force. Next, the camber or fin, i.e. poor perpendicular of edge face, generates depending on inclining distribution of stress in the thickness direction. And furthermore, the generation of spring-forward or poor accuracy of bending-bottom is based on a physical behavior that the bend-working brings about some waving of said material. However the factors bringing about the above-mentioned defects are easily possible to be eliminated by this invention method and device as shown in FIG. 1. Speaking in details, it is as follows.

According to FIG. 1, it is apparent that the bending deformation region is subjected to compressive force depending on the counter-pressure (Fc), exerted by the counter rod 3 to the thickness direction of material 3, during bend-working. In such a case, the outside surface of the material sustains a bend-stretch, i.e. becoming a certain tension-rolling, under the compressive stress. Therefore, the stress in the plane direction of the material is converted into a compressive force. Such a physical behavior under the counter pressure means that both of the inside and outside surface of the material sustain a compressive force. The effects thereby are excellent actually, as follows.

First, naturally no cracks are generated.

Next, the above-mentioned inclining destribution of stress in the thickness direction is remarkably reduced, consequently, generation of chamber or fin is little.

Furthermore, the waving of bending deformation region is avoided depending on the substantial tension-rolling as mentioned above and the lowering of bending force thereby. Accordingly, the spring-forward or poor accuracy of bended bottom is not generated.

Such a function of this invention and effects thereby will be made clearer in the following examples. The practical requirements in examples are as follows.

A bending mechanism such as its main part-shown in FIG. 1 is employed in the experiments. A punch having a shoulder radius of 0.2 to 10mm is driven by a known mechanism of hydraulic cylinder under suitable velocity. A counter rod is also driven by the similar mechanism and its variable amount of adding compressive force if within the range of 0 to 1.8t. The test materials are as shown in Table I and selected from the points of view; i.e. the known work hardening index (*n* value) is low; a bending-crack tends to be generated and the bend-working is difficult to carry out (including a large amount in spring-back)

Table I

| No. | Kind of material | Thickness (m/m) | Width (m/m) | Length (m/m) |
|---|---|---|---|---|
| 1. | Bainite steel, Hv360 | 1.0 | 20 | 50 |
| 2. | Bainite steel, Hv380 | 2.0 | 20 | 50 |
| 3. | Carbon steel, 0.45%C | 3.0 | 20 | 50 |
| 4. | Carbon steel, 0.20%C | 3.0 | 20 | 50 |
| 5. | Cr-Ni system steel | 0.4 | 20 | 50 |

Table I-continued

| No. | Kind of material | Thickness (m/m) | Width (m/m) | Length (m/m) |
|---|---|---|---|---|
| 6. | Sintered powder of iron | 1.0 – 5.0 | 10 | 55 |

Note:
No. 1; hot-rolled sheet
No. 5; cold-reduced stainless for spring of communication equipment
No. 6; sintering in a reducing atmosphere after forming The test results of the above materials are as follows, in each of items of the above-mentioned bend-working difficulties.

1. Test on bending-crack

Figure 3:
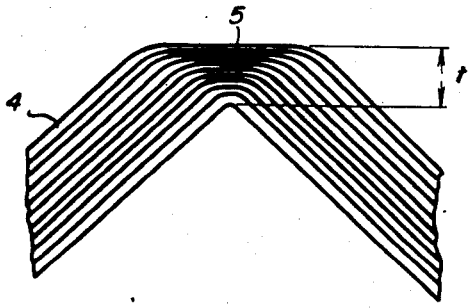
FIG. 3 is a side view of bending deformation region by this invention.

This test is 90° bend-working to the rolling direction by a flat counter pressure rod having an upper face of 10mm for the above materials. FIG. 3 shows the shape of the bending deformation region of No. 2 steel thereby, which appears like a characteristic line. It may be good as a design. In the above case, the initial thickness (to) is was reduced to (*t*). It is, however, confirmed that the reducing rate is slight and there is little anxiety in strength and the generation of no crack under a bending radius (*rp*) of 0.2 to 0.5mm.

Figure 4:
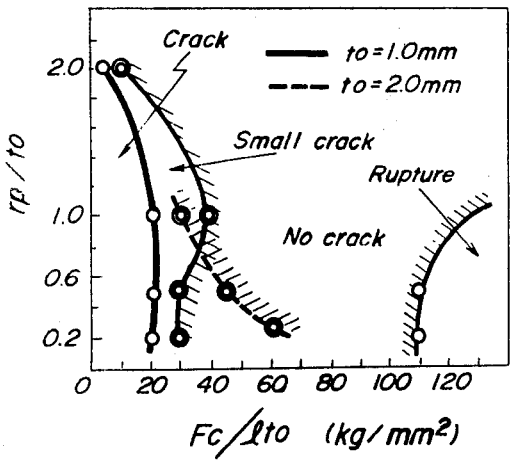
FIG. 4 is a graph showing a relation between a bending radium (*rp*) and a counter pressure (F*c*), by this invention.

FIG. 4 is a graph showing a relation between the counter pressure (Fc) and the bending radius (*rc*) for the bainite steels, i.e. No. 1 and No. 2 steels, tending to generate the bending-crack. In this test, the prior art brought about a crack in every steel, resultng in cut-off thereof. However, in this invention, method and device, the crack perfectly disappeared as the counter-pressure (Fc) increased and good bending-work was carried out. The details of test are as follows.

According to FIG. 4, it will be understood that the effects of preventing generation of the crack depending on the counter pressure (Fc) are far greater than that of the bending radius. That is, in such a case of 1.0mm in thickness the scope of about 30kg/mm² in Fc to about 110kg/mm² is a stable one of no crack and in thickness of 2.0mm, the scope of more than about 30kg/mm² to about 60kg/mm². It is needless to say to show the same tendency also on an actual operation.

The generation of defects, such as cracks for 90° bend-working on the materials in Table I are shown in Table II.

Table II

| No. | Kind of steel | Thickness (mm) | Edge Fc/l | 0 | 10 | 20 | 30 | 40 | 50 | 60 | 70 | 80 | 90 | 100 | 110Kg/mm |
|---|---|---|---|---|---|---|---|---|---|---|---|---|---|---|---|
| 1 | Bainite steel | 1.0 | Machining | ⊗ | ◑ | ◑ | O | ◎ | ◎ | ◎ | ◎ | ◎ | ◎ | ◎ | ⊗ |
| 2 | Bainite steel | 2.0 | Machining | ⊗ | ◑ | ◑ | ◑ | O | O | ◎ | ◎ | ◎ | ◎ | ◎ | |
| 3 | Carbon steel | 3.0 | Machining | ◑ | ◑ | ◑ | ◑ | O | ◎ | ◎ | ◎ | ◎ | ◎ | | |
| 5 | Stainless steel | 0.4 | Machining | ⊗ | ◑ | ◑ | O | ◎ | ◎ | ◎ | ◎ | ◎ | ◎ | | |
| 6 | Sintered powder | 5.0 | Machining | ⊗ | ◑ | O | O | ◎ | ◎ | ◎ | ◎ | ◎ | ◎ | | |

Note;
◎ , no crack
O, small crack
◑ , crack
⊗ , rupture

In view of results shown in Table II, it is obvious that a crack or the resultant rupture generates on every steel. In a case by this invention method and device, there is no crack under a requirement of each of $Fc \geqq 40$Kg/mm on No. 1 steel, $Fc \geqq 60$Kg/mm on No. 2 steel, $Fc \geqq 54$Kg/mm on No. 3 steel, $Fc \geqq 40$Kg/mm on No. 5 steel, and $Fc \geqq 30$Kg/mm (That of material of other thickness also was the same.). Thus, it will be understood that the effects depending on the counter pressure (Fc) based on this invention is far greater than that of the prior art.

The above-mentioned description is on plane strain-cracking of the machined edge. At the same time, it is confirmed that this invention method and device is effectual for preventing known sheared edge crack. In general, bend-working is used for punched-cut products and the sheared edge crack tends to occur in many cases. However, with this invention method and device, such a tendency of frequent occurrence of said crack may be prevented. The following Table III is the results of the bending-work based on this invention on the above No. 1, No. 2 and No. 3 steel.

Table III

| No. | Thickness | rp | Edge | Fc/1 | 10 | 20 | 30 | 40 | 50 | 60 |
|---|---|---|---|---|---|---|---|---|---|---|
| 1 | 1.0 | 0.5 | B | | | O | | ◎ | | ◎ |
| | | | D | | | O | | O | | O |
| | | | B | | | | | | | |
| 2 | 2.0 | 0.5 | | | | | | | | |
| | | | D | | | | | | | |
| | | | B | | | | | | | |
| 3 | 3.0 | 0.5 | | | | | | | | |
| | | | D | | | | | | | |
| | | 70 | 80 | 90 | 110Kg/mm | | | | | |
| | | | ◎ | | ◎ | | | | | |
| | | | ◎ | | ◑ | | | | | |
| | | | ○ | | ◎ | | | | | |
| | | | O | | ○ | | | | | |
| | | | ◑ | | ◎ | | | | | |
| | | | ◑ | | ◎ | | | | | |

Note:
B fin, tension side
D looseness, tension side
◎ rupture
◑ crack
O small crack
◎ no crack From the above Table III, it is almost certain that even the sheared edge crack will disappear when using this invention method and device. When the counter pressure rod having an upper face of shape shown in FIG. 2(C) was employed in place of the flat upper face used in the examples, the above disapperance of the sheared edge crack was more certain than those of Table III. It was furthermore discovered that when the edge side having some burr was placed outside, i.e. tension side the crack disappeared and when edge side having the looseness was placed on the same side conversely said crack occurred. In either case, a kind of such cracks spread to the inner part from the edge in a case of a small counter-pressure. Accordingly, it should be noted that it is possible to limit cracks to only the edge, although the generation of the cracks will be wholly avoided.

2. Test on spring-back

Figure 5:
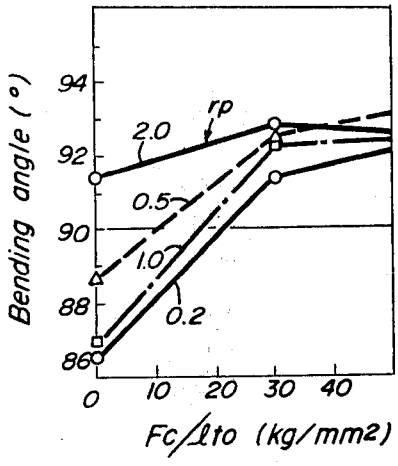
FIG. 5 is a graph showing a relation between a bending angle ($\theta$) and a counter pressure (F*c*), which is dependant on various bending radius (*rc*) by this invention.

The testing for spring-back based on this invention method and device is as follows. That is, the influence of bending angles corresponding to various bending radii is shown in FIG. 5. In this test, a pushing-up pressure at the finishing time of the bending-work was $5t$. As apparent from FIG. 5, it will be understood that an amount of the spring back increases as $rp$ is larger and the influence of Fc decreases as said $rp$ is larger, in case of a small $rp$. Thus, it is a fact that the counter-pressure (Fc) influences the anount of the spring back. In other words, the material being in a region of spring forward shifts to a region of spring back, depending on the counterpressure. Actually, a counter-pressure crossing on 90° line in FIG. 5 should be exerted to reduce the amount of spring back. In such a case, it is needless to say that the minimum counter-pressure being possible to avoid the generation of the abovementioned crack should be selected. The steel of this test, i.e. No. 1 steel, is one of many steels having a great tendency to generate cracks and thus generally needs the minimum $rp$ of $> 2t$. However, when a material bringing about occurrence of no crack under bend-working is used, a far lower Fc than that of this test is possible to be used.

Figure 6:
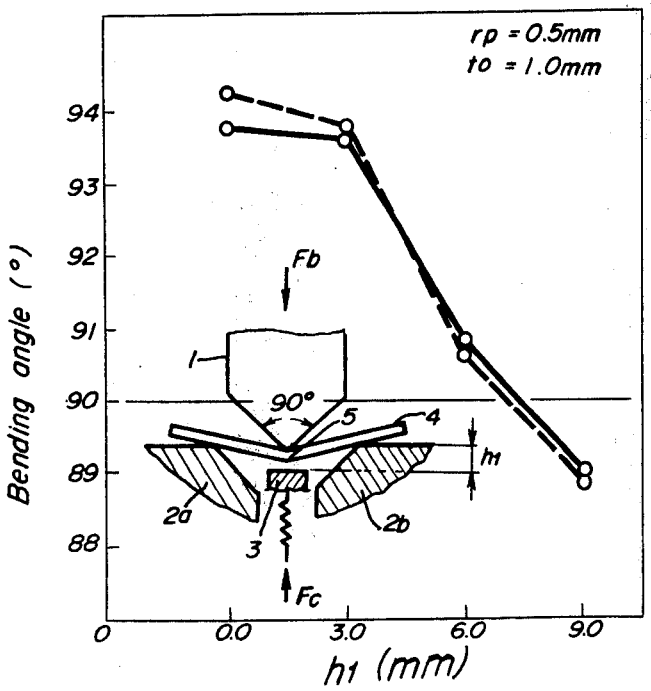
FIG. 6 illustrates a relation between a bending angle ($\theta$) and a height of from the upper face of counter rod to the same of die by this invention.

A recommended method for controlling the amount of the spring back is shown in FIG. 6. At the starting stage of bend working in this invention, the upper face of the counter-pressure rod or plate is placed at level of the die. On the contrary, when a position of the rod is lowered by "h1" from the level, the controlling of the spring back or spring-forward became easy and sure. Specifically, the requirements of bend-working in FIG. 6 were as follows. That is, $rp$ is 0.5mm Fc/l is 80Kg/mm or 50Kg/mm and then "h1" is from 0.0 to 9.0mm. According to FIG. 6, it is obvious that the occurrence of spring back is easily avoided under "h1" of about 0.6mm. And no more crack occurred in this case. The controlling of the "h1" can be easily and surely carried out by simply adjusting the height of the counter-pressure rod or plate.

3. camber and fin

Figure 7:
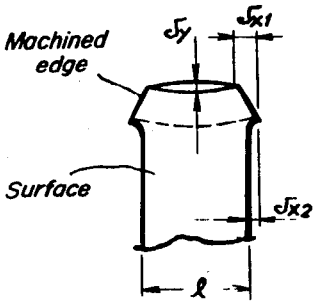
FIG. 7 PRIOR ART
FIG. 7 is a front view based on the prior art.

As mentioned above, it is known that a camber is generated and perpendicular precision of an edge face becomes poor under a general bend working e.g. $rp$=0.5mm and Fc=O. A shape of the edge obtained thereby is shown in FIG. 7 for No. 4 steel. In FIG. 7, the shape of the prior art was as follows. That is, the amount of the camber "$\zeta y$" is 0.2mm and the amount of the fin, i.e. perpendicular precision, is $\zeta \times 1$ of 0.85mm and $\zeta \times 2$ of 0.4mm. On the contrary, when the same steel was bend-worked under the same requirements of $rp$ and $Fc$=50Kg/mm$^2$, the perpendicular precision obtained thereby showed the values of full zero $\zeta y$. 0.3mm $\zeta \times 1$ and 0.25mm $\zeta \times 2$. Thus, the generation of the fin, i.e. perpendicular precision on the edge, is greatly improved as well as no camber is generated.

4. Accuracy of bended bottom and universal bending.

Figure 8:
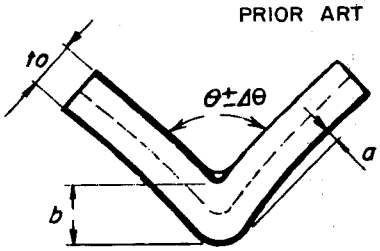
FIG. 8 PRIOR ART
FIG. 8 is a side view based on the prior art.
Figure 9:
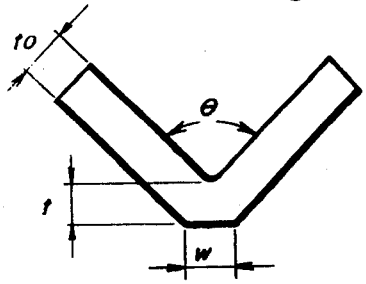
FIG. 9 is a side view based on this invention.
Figure 10:
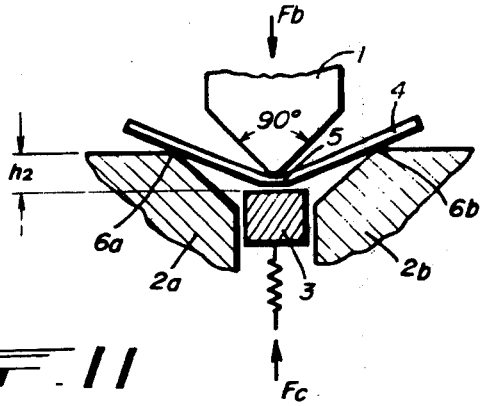
FIG. 10 is an explanatory view concerning a principle of this invention for a general use.

In the prior art, the waving of bend-worked region was seen. It is known that such waving greatly influences the generation of the spring back or spring forward. An example based on waving is shown as portion (a) in FIG. 8. In view of improving such a defect, a specialized shape of the bottom or a high pushing-up pressure for the bottom is presented and put into practice. However, the improving of the defect was not sufficient. On the contrary, when the material is bend-worked by this invention method and device, the keeping of excellent accuracy of the bending deformation region as shown in FIG. 9 is easily and surely obtained. This is as mentioned above, based on the fact that a stretch force on the outside surface of the material is converted into a compressive-force towards the thickness direction under a counter-pressure and no craving generates based on the resultant lowering of the bending force. This is of use for not only improving the above-mentioned defects, but also for increasing the utility of this invention. That is, it is to control the bending angle by the adjusting of a bending force. FIG. 10 is one example based on the above manner of bending. "h2" in FIG. 10, which is a distance from the level of the die surface to the upper-face of the counter-pressure rod or plate, is adjusted according to a required bending angle. In such a case, the pressure by the punch and the counter-pressure rod and plate is smaller than the pushing-up pressure used in the prior art at the finishing time of the bending-work. Accordingly, the press capacity employed in such a bending-work is possible to be reduced.

The above-mentioned art was on the materials having a low work-hardening index (i.e. *n* value), which is well-known in the press-forming field. However, another consideration is required for a material having a high *n* value, e.g. a soft steel. That is, from many experiments, it is confirmed that the point to be considered lies in a distance between the seperated dice and most suitable range of the distance should be selected depending on the *n* value of material. Every steel shown in Table I has a low *n* value, i.e. low work-hardenability. Accordingly, even if the distance is set up independently of the thickness (to) or the *n* value, the bending deformation was localized beneath the shoulder of punch and the deformation in the rest of the material went through elastic recovery to achieve bending-work with excellent shape accuracy. On soft steels with a higher *n* value, it is well-known that the deformation resistance thereof gradually increases as the bend working proceeds. Therefore, the soft steel just beneath the end of punch in the initial stage of working is bend-deformed at the biggest bending moment, and then the deformation resistance increases by the work-hardening caused through deforming and the plastic deformation thereby extends to the periphery which has not yet been work-hardened. Consequently, the bend-deforming manner as shown in FIG. 3, which is extending to the whole of material between dice is brought about.

Figure 11:
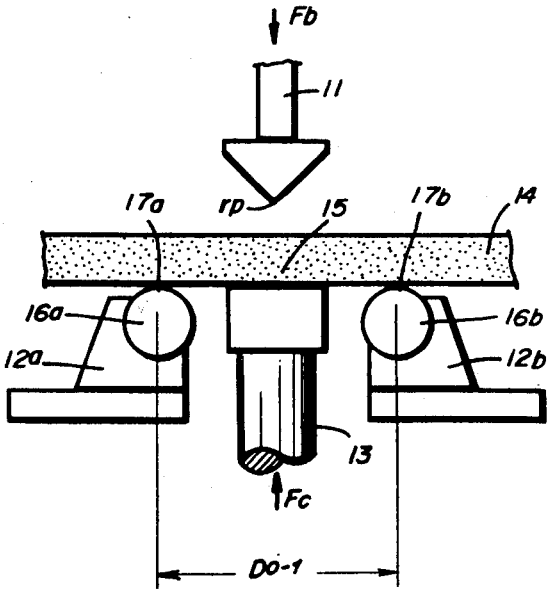
FIG. 11 and 12 are an example of practical manners based on this invention for a soft steel having a high wor-hardening index (*n* value), respectively.

In such a point of view, the best-suited requirements for bend-working the soft steel has been decided. The above requirements lie in the fact that the bending deformation is localized just beneath the end of the punch and should not extend to the periphery of the localized portion. This is done by narrowing and limiting the distance between the dice. FIG. 11 is one of examples for realizing the above method.

Referring to FIG. 11 and other drawings, the mechanism shown in the drawing is fundamentally similar to that in FIG. 1. That is, numeral 11 denotes a punch; 12*a* and 12*b* are seperated dice, respectively, provided with rollers (16*a* and 16*b* for preventing scratches on steel. 13 is a counter-pressure rod or plate arranged at the center of the dice 12*a* and 12*b*. In order to bend-work with such a device, a steel 14 is placed on the dice 12*a* and 12*b* as shown in FIG. 11 upon which lowers the punch with a pushing-down pressure F*b*, while the counter-pressure F*c* is put on the rod 13 through an air or liquid pressure mechanism (not shown). the bending deformation region 15 of the steel is intercepted locally by the punch 11 and the counter-pressure rod 13 and a pushing-down pressure to thickness is put on the part while the punch 11, said rollers 16*a* and 16*b* and the counter rod 13 together take part in the bending deformation work. The distance between the contacting points 17*a*, 17*b* in FIG. 11 and 18*a*, 18*b*, which is a point contacting the steel 14 with rollers 16*a*, 16*b* respectively, changes from D*o*-1 of FIG. 11 to D*o*-2 of FIG. 2 in the bending-work. In this invention, at least one of the above distances, i.e. D*o*-1 and D*o*-2, should be set up within the range of about 3.5 to 6 times the steel thickness.

Figure 13:
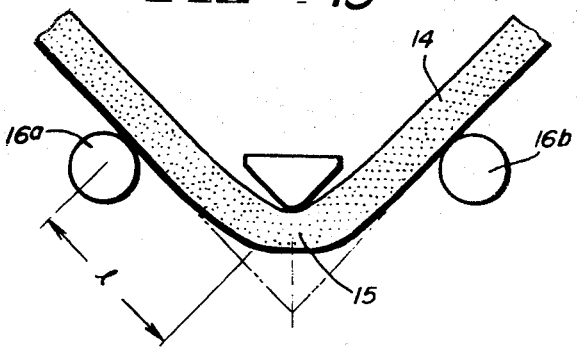
FIG. 13 is an example of practical manner dependant upon the prior art for the same steel.

If the distances D*o*-1, D*o*-2 are increased to over six times the thickness of steel, accuracy or precision of the shape obtained after bend-working becomes poor as shown in FIG. 13. This is because the bending deformation tends to extend to the wider region than that of deformation to be localized with the reasons stated above. Therefore, the upper limit of the above distance is made narrower to about 6 times the thickness of the work piece steel.

Figure 14:
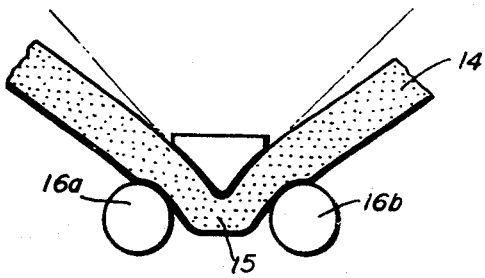
FIG. 14 is another example in the same way.

On the contrary the reducing of the above distance for localizing the deformation is also to be limited. That is, if the distance is made very small, such as below 3.5 times of the thickness, then the final shape obtained becomes as shown in FIG. 14. It is needless to say that such a shape should be avoided. This is attributable to a too-big bending force, and thereby, the steel is forced into the very narrow die-opening, i.e. the above distance. Consequently, a carve towards the outside of steel and uneveness of the thickness are brought about. This is a reason why the above distance is limited to not less than 3.5 times as many as the thickness of steel, as the lower limit.

Thus, when a bending work is carried out on a soft steel having a high work-hardening index (*n* value) by a device comprising a pushing-down punch, a counter-pressure rod or plate thereagainst and a pair of dice wherein the distance between the both dice, i.e. die-opening, is set up within the range of 3.5 to 6 times the thickness of the steel, bending deformation region, being excellent in shapability and accuracy, is easily and surely obtained. Such a precision bend-working method and its device will be further apparent from the following example.

The following Table 4 discloses the bend-worked results on the actual steels having a high *n* value. This bend-working requrements are as follows. That is, the bending angle is 90°, and the pushing-down pressure of the punch F*b* and the counter-pressure F*c* were respectively 87.0t and 43.2t when the width of steel 4 was 60mm.

Table 4

| No. | Kind of steel | Thickness mm | Die-opening (1) mm | Thickness ratio | Die-opening (2) mm | Thickness ratio | Results |
|---|---|---|---|---|---|---|---|
| 1 | ASTM. A-242 | 40 | 300 | (7.5) | 260 | (6.5) | X FIG.13 |
| 2 | A-242 | 40 | 220 | (5.5) | 180 | (4.5) | O FIG.12 |
| 3 | ASTM. A-242 | 40 | 200 | (5) | 160 | (4) | O FIG.12 |
| 4 | ASTM. A-36 | 10 | 30 | (3) | 27 | (2.7) | X FIG.14 |
| 5 | A-36 | 6 | 30 | (5) | 27 | (4.5) | O FIG.12 |
| 6 | A-36 | 4 | 30 | (7.5) | 27 | (6.75) | X FIG.13 |

Figure 12:
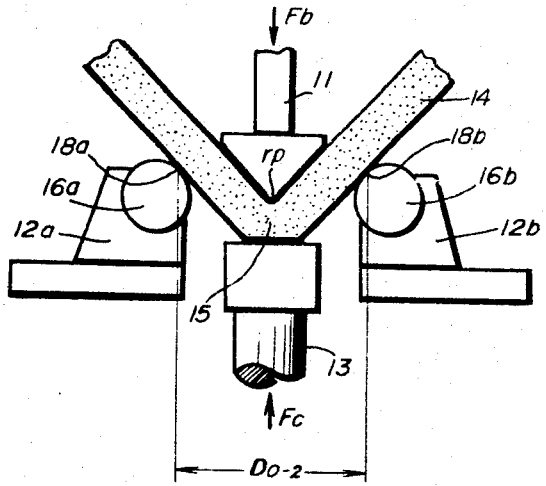

In Table 4, each of steels 2, 3 and 5 was bend-worked under a thickness ratio, i.e. (die-opening)/(thickness of steel), based on this invention and resulted in an excellent shapability and accuracy as shown in FIG. 12, while each of steels 1, 4, and 6 is out of the ratio and consequently is far inferior to the above steels in the shapability and accuracy as shown in FIG. 13 and 14. Thus, it is will be understood that the bending work should be performed under a thickness ratio of 3.5 to 6.0. The above description is on a 90° bending work. It is, however, needless to say that an optional bending angle may be selected in such a manner as the above explanation on said FIG. 6, 10 and the others. In the same way, a shape of said die also may optionally be selected, e.g. a fix-type die having some radius in its shoulder portion or the like, apart from the accompanying drawings.

We claim:

1. A Method of substantially exact bending of metal material wherein the material is subjected to a force in the bending region between supporting dies and wherein the surface of the material on the other side is subjected to a counter force between the supporting dies, characterized in that the force which causes the bending is introduced locally along a line or a narrow area corresponding to the axis of bending, and that the material on the side of and in contact with the counterforce is deformed permanently by this force, the thickness of the material thereby being reduced for forming a localized bend along said line without cracks.

2. Method of bending of steel of high deformation hardening according to claim 1, characterized in that the distance of the supporting dies are adjusted to 3.5 to 6 times the thickness of the steel material.

* * * * *